United States Patent [19]

Myhren et al.

[11] Patent Number: 4,526,678

[45] Date of Patent: Jul. 2, 1985

[54] APPARATUS AND METHOD FOR SEPARATING LARGE FROM SMALL PARTICLES SUSPENDED IN A GAS STREAM

[75] Inventors: Jan Myhren; Svein E. Gitlestad, both of Sewickley, Pa.

[73] Assignee: Elkem Chemicals, Inc., Pittsburgh, Pa.

[21] Appl. No.: 506,634

[22] Filed: Jun. 22, 1983

[51] Int. Cl.[3] ..... B07B 3/00

[52] U.S. Cl. ..... 209/2; 209/139 A; 209/144; 209/145; 209/148; 373/9

[58] Field of Search ..... 209/139 A, 143, 144, 209/145, 148, 138, 2; 373/9

[56] References Cited

U.S. PATENT DOCUMENTS

| | | | |
|---|---|---|---|
| 535,099 | 3/1895 | Gale et al. | 209/144 |
| 1,620,241 | 3/1927 | Stebbins | 209/144 |
| 2,044,915 | 6/1936 | Mosley | 209/144 |
| 2,402,190 | 6/1946 | Van Der Ply et al. | 373/9 |
| 3,017,993 | 1/1962 | MacPherson et al. | 209/144 |
| 3,091,334 | 5/1963 | Morton | 209/144 |
| 3,667,600 | 6/1972 | Oi et al. | 209/144 |
| 4,001,121 | 1/1977 | Bielefeldt | 209/144 |
| 4,125,456 | 11/1978 | Henderson | 209/138 |
| 4,248,699 | 2/1981 | Hukki | 209/144 |

FOREIGN PATENT DOCUMENTS

| | | | |
|---|---|---|---|
| 739728 | 10/1943 | Fed. Rep. of Germany . | |
| 175013 | 2/1935 | Switzerland . | |
| 85 | of 1885 | United Kingdom | 209/144 |
| 399465 | 1/1932 | United Kingdom | 209/144 |

*Primary Examiner*—David L. Lacey
*Attorney, Agent, or Firm*—Lucas & Just

[57] ABSTRACT

The present invention is directed to apparatus and a process for separating large from small particles suspended in a moving stream of gas by centrifugal forces which in a preferred embodiment includes sifting of large particles in a stream of gas to strip small particles away from the larger particles. The apparatus and process is especially adapted for separating dry finely divided particulate materials having small particles from about 0.05 micron to about 45 microns from larger particles suspended in the moving gas stream.

14 Claims, 9 Drawing Figures

OUT
IN
D
C

APPARATUS AND METHOD FOR SEPARATING LARGE FROM SMALL PARTICLES SUSPENDED IN A GAS STREAM

This invention relates to a system and apparatus for separating large particles from small particles in finely divided particulate materials by means of centrifugal force. After separation, the large particles are preferably stripped of small particles for the most efficient operation.

In many industrial operations finely divided particulate materials such as grain, flour, metal, pigments and fines removed from furnace stack gases contain objectionable large particles such as dirt, wood chips, coke, rust and scale which detract from use of the material.

In accordance with the present invention, finely divided particulate material is suspended in a moving stream of fluid and preferably in a gas stream such as ordinary air or furnace stack gas. The moving fluid stream with suspended particulate material is fed into an enclosed conduit or pipe which is arranged in a circular path. As the fluid stream travels in the circular path of the enclosed conduit, the large particles move outwardly and become more highly concentrated adjacent the exterior wall of the conduit while the smaller particles remain suspended in the main body of the fluid stream. When the desired separation of large and small particles is obtained, the stream is divided into two separate streams. One stream contains a high concentration of large particles suspended therein and the second stream has a high concentration of small particles suspended therein.

In one preferred embodiment of the invention, dry, finely divided particulate material is suspended in a stream of furnace stack gas which is fed into an enclosed conduit or pipe. The suspended large and small particles both move in the same direction along with the flow of moving gas. The number of bends and length of bend in the circular path of the enclosed conduit is determined by the relative concentration of the large and small particles and the separation between large and small particles desired for the material at hand.

The bends in the circular path of the enclosed conduit may be separated by relatively straight sections but separation of particles is more efficiently carried out if the enclosed conduit is arranged in a continuous circular path so that the moving suspended particles are constantly subjected to centrifugal forces that separate the large from the small particles. The enclosed conduit may be arranged to pass through an arc of a circle or through one or more complete circles or in a spiral, helix and the like.

In some instances it may be desirable to separate the particles into fractions of small, medium and large particles. This is most conveniently done by dividing the gas stream of suspended particles into two separate streams at the end of a first circular path to separate the large particles from the body of the main stream and by again dividing the stream into two separate streams at the end of a second circular path to separate the medium size particles from the main body of the gas stream that contains the smallest particles suspended therein. For this purpose, the enclosed conduit may be arranged in a single circular path wherein division of the stream occurs at selected spaced sections in the circular path or by arranging the enclosed conduit in a first circular path connected by a straight section of conduit to a second circular path wherein the stream is divided into separate streams at the end of each circular path.

The enclosed conduit may have any desired internal area configuration. The internal area may be constant throughout the length of the conduit or the internal area may be expanded or contracted depending on the desired operating parameters as will be obvious to those of skill in the art in accordance with the concept of the present invention. The flow of the air stream of suspended particles in the enclosed conduit may be under a positive, above atmospheric pressure, or under a negative, below atmospheric pressure, generated in conventional manner by conventional vacuum air pulling devices or by conventional air pushing devices that provide an air stream under pressure or above atmospheric pressure.

The separated gas stream that contains a high concentration of large particles may also contain some small particles. The small particles may be recovered by feeding the separated stream with the high concentration of large particles into a second enclosed conduit arranged in a circular path which is the same as the primary particle separator but reduced in size relative to the smaller volume of the separated stream having a high concentration of large particles suspended therein.

The small particles are most efficiently stripped from the large particles in the separated gas stream by sifting the large particles in a secondary air or gas stream. For this purpose, the separated gas stream from the primary particle separator is fed into a secondary small particle recovery vessel. The separated stream is fed to flow down tangentially adjacent to the cylindrical wall of the vessel which tapers down to an outlet port for removal of the large particles. The gas stream flows down adjacent the wall in a spiral path and as a result the large particles are further concentrated adjacent the wall of the vessel while the swirling characteristics of spiral flow cause small particles to move into the central open body of the secondary small particle recovery vessel.

In moving down adjacent to the wall of the secondary recovery vessel, the layer of large particles pass around the sides of a circular baffle where they are stripped of entrained small particles by means of secondary air injected through one or more inlet ports positioned below the baffle. The secondary air moves up through the layer of large particles at the sides of the baffle and thereafter upwardly into the central open body portion of the vessel to carry the small particles up through an outlet port in the top of the vessel. In the preferred embodiment, the stream of secondary air with small particles suspended therein are fed back into the main body of the gas stream to join the small particles suspended therein. The small particles are recovered from the main body of the gas stream in the primary particle separator in any conventional manner as by feeding the gas stream into a cyclone separator.

Best results have been achieved by means of an enclosed conduit arranged in a circular path of 360° for the primary separation of the large and small particles. The internal area of the enclosed conduit is constant from the inlet to the outlet port. The inlet port is preferably of rectangular configuration which is gradually changed by decreasing the height of the outer wall with a corresponding increase in width in order to maintain a constant interior area. Reducing the height of the outer wall of the rectangle squeezes the air stream down adjacent the outer wall which results in concentrating the large particles in a smaller volume of gas. This in turn, increases the efficiency of large and small particle separation and it reduces the volume of air with the large particles suspended therein that is fed to the secondary small particle recovery system.

The apparatus and system of the present invention is inexpensive, has no moving parts and does not tend to clog up. Another great advantage is that it can be readily inserted into an existing system used for collecting furnace stack gas fines without disrupting the existing equipment.

These and other advantages of the system and apparatus of the present invention may be readily understood by reference to the drawings which illustrate preferred embodiments and in which.

Figures 1, 6:
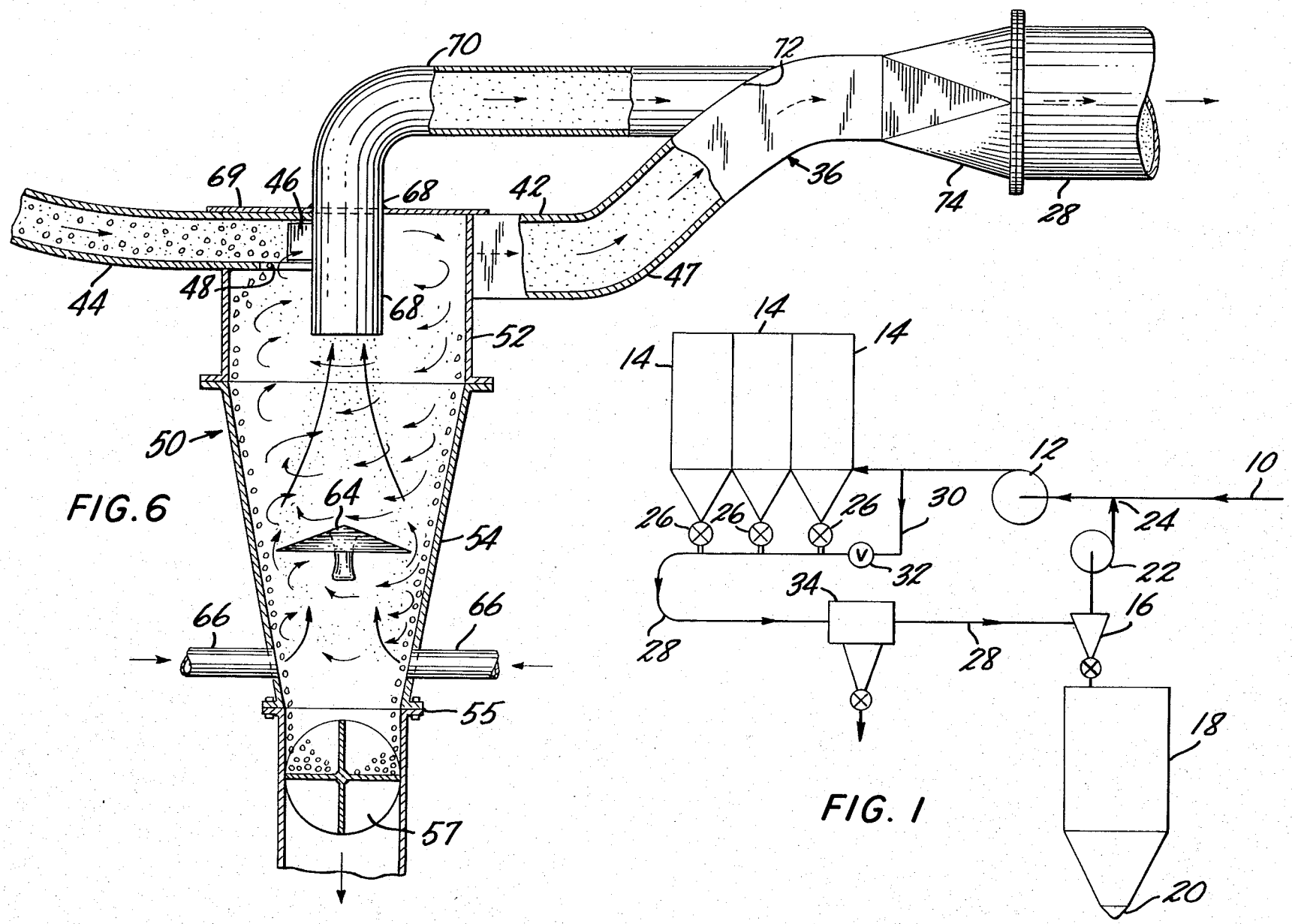
FIG. 1 illustrates one way in which the apparatus may be installed into an existing furnace stack gas particle collection system to form the system of the present invention.
FIG. 6 illustrates the preferred secondary particle separation and recovery unit for stripping small particles from the air stream of suspended large particles that is separated from the main fluid stream of the primary separator of FIG. 4.

Turning now to FIG. 1, the furnace stack gas from a conventional ferrosilicon or silicon metal electric reduction furnace is fed through a pipe 10 into conventional apparatus for collection of finely divided particulate material therein. A conventional fan 12 feeds the furnace off-gas under positive pressure into one or more conventional collectors 14 which separate the solid material from the stream of gas. A portion of the off-gas is diverted through enclosed pipe conduit 30 to the fume transport enclosed pipe 28 and is controlled by valve 32.

A fan 22 pulls the gas through the transport pipe 28 and cyclone 16 in conventional manner and recycles the air stream back into the collection system at 24.

The transport system is fed in conventional manner by the air lock valves 26 which control the flow of air with suspended finely divided particulate material into the enclosed pipe conduit 28 which feed into one or more conventional cyclones 16 which separate the solid material from the transport gas stream. The separated solids are collected in a silo 18 and withdrawn as desired at 20.

Figures 2, 7, 8:
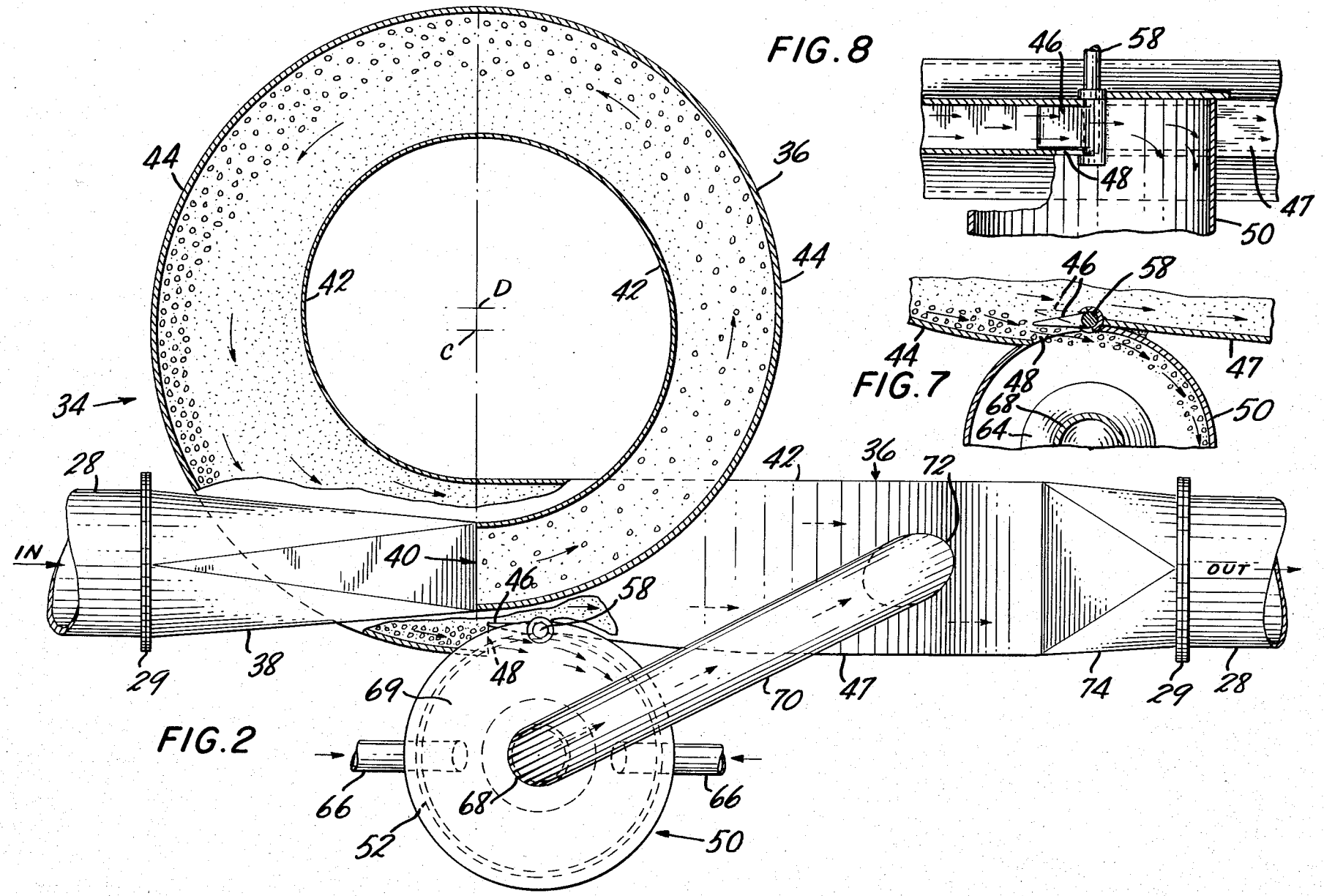
FIG. 2 is a top view that illustrates one preferred form of the primary and secondary particle separation and recovery apparatus of this invention.
FIG. 7 is a top view that illustrates one form of damper for controlling the flow of the gas stream in which the large particles are concentrated through the outlet port of the primary separator into the secondary separator and small particle recovery system.
FIG. 8 is a side view that illustrates the damper of FIG. 7.

The apparatus 34 of the system of the present invention for separating the large from the small particles suspended in the air stream of pipe 28 is conveniently inserted into pipe 28 between collectors 14 and the one or more cyclones 16 by means of standard flange pipe connectors 29 shown in FIG. 2.

In this typical example, the diameter of pipe 28 was ten inches. The air stream in pipe 28 before entering the 'Spirator' apparatus 34 contained one hundred and ten grams of solids per cubic meter of transport gas. The solids have an average specific gravity of about one hundred and thirty five pounds per cubic foot. The finely divided solid particulate material suspended in the gas stream entering apparatus 34 had a typical particle size of 0.05 micron up to about one-half inch and typically up to 10% of the particles were over 45 microns in size. The particle size in the gas stream entering cyclone 16 after being subjected to large and small particle separation in accordance with the present invention at 34 was typically about 0.05 micron to about 45 microns. The air stream with suspended particles in pipe 28 fed to Spirator 34 had a typical velocity of about twenty seven to about thirty two meters per second.

Figure 5:
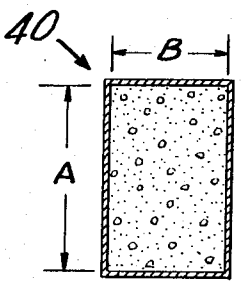
FIG. 5 illustrates the inlet port to the enclosed conduit of FIG. 3.

As best shown in FIG. 2, Spirator 34 comprises a primary small and large particle separator 36 that receives the air stream with suspended large and small particles from pipe 28 through an enclosed connector conduit 38 which in known manner effects a change from the round configuration of pipe 28 to the generally rectangular configuration of the inlet port 40 (FIG. 5) of primary separator 36. The generally rectangular inlet port 40 has a height 'A' of ten inches and width 'B' of six inches. The area of inlet port 40 is less than the interior area of pipe 28 which increases the velocity of the air stream of suspended particles.

Figure 4:
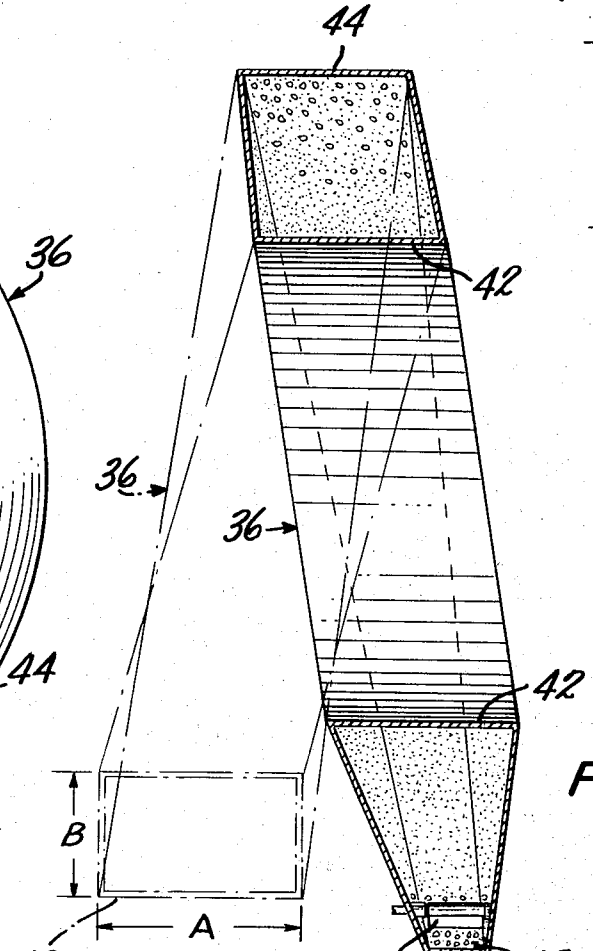
FIG. 4 is a perspective view of a portion of the enclosed circular conduit of FIG. 3 that illustrates the outlet port.
Figure 3:
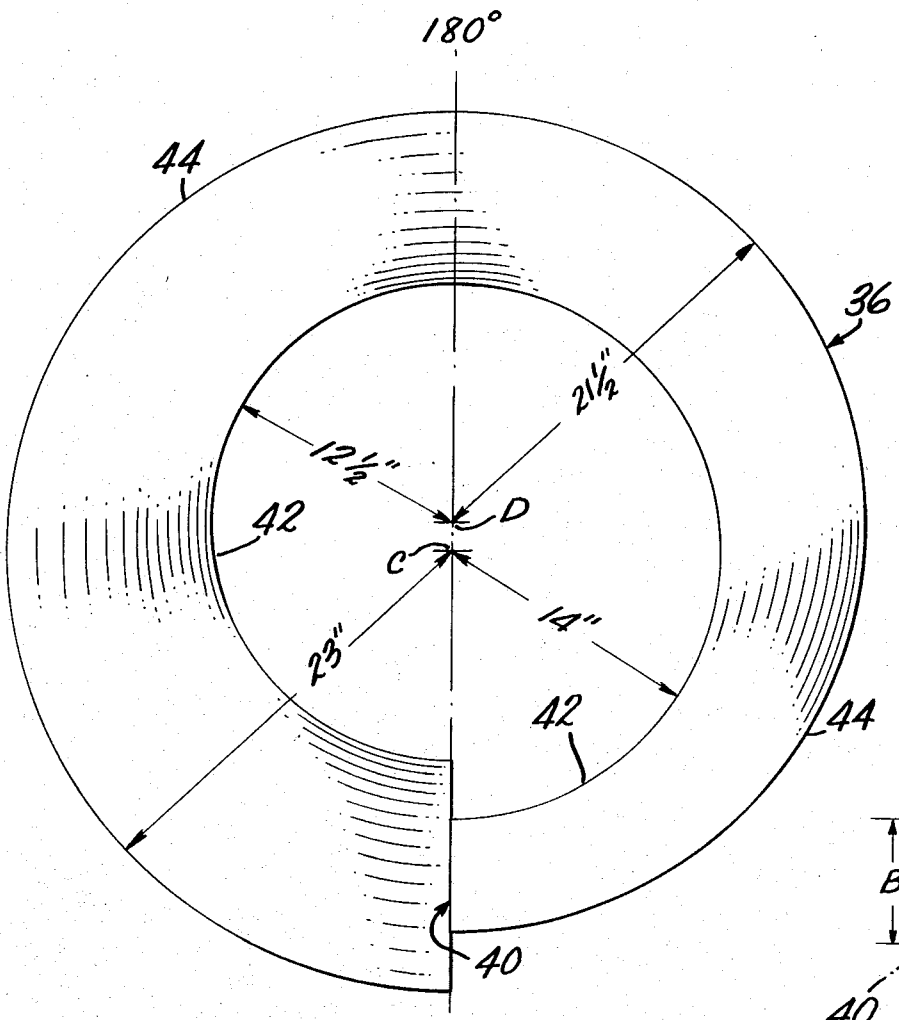
FIG. 3 is a top view of the enclosed conduit of FIG. 2 that illustrates geometry of a preferred circular path for primary particle separation.

As best shown in FIGS. 2, 3 and 4, the primary separator 36 is arranged in a 360° circular path based on two separate centers. The first center 'C' is used to delineate the line of the inner wall 42 of separator 36 from the inlet port 40 through the first 180° of the circular path in counter-clockwise direction (FIG. 3) on a fourteen inch radius. The second center 'D' is used to delineate the line of the inner wall 42 through the second 180° of the circular path in counter-clockwise direction (FIG. 3) on a radius of twelve and one-half inches. The center 'D' is used to delineate the line of circular path of the outer wall 44 on a twenty one and one-half inch radius for the first 180° and center 'C' is used to delineate the line of the outer wall on a twenty three inch radius through the second 180° in counter-clockwise direction (FIG. 3). The enclosed conduit of the primary separator is arranged to slope downwardly in the counter-clockwise direction of the flow of the air stream so that the conduit at the end portion of the 360° circular path can pass under the enclosed conduit 36 where the circular path starts at inlet 40 (FIG. 2).

The outer wall 44 of the primary separator 36 is gradually reduced in height from ten inches 'A' at the inlet port 40 to three inches 'A' near the end of the 360° (FIG. 4) circular path and the width of the enclosed conduit is correspondingly increased to maintain a constant interior area. With this typical construction, a four inch drop in water pressure was measured between the pressure of the air stream at inlet port 40 and at the end of the 360° circular path. The enclosed conduit of the primary separator 36 was a welded structure of mild steel of $\frac{3}{8}$ inch thickness for outer wall 44 and $\frac{1}{4}$ inch thickness for inner wall 42. Any suitable material of desired thickness may be used in constructing the primary separator 36 of this invention.

As best illustrated in FIGS. 2 and 4, the large particles in the air stream move out toward the outer wall 44 as the air stream follows the circular path in primary separator 36. The large particles become concentrated adjacent to the outer wall 44 and the concentration of large particles is further increased by squeezing down the interior volume of the enclosed conduit adjacent to the outer wall. This squeezing down is also of advantage for decreasing the volume of air in which the large particles are suspended. In this typical example the furnace off-gas contained silica particles about 50% of which were less than one micron in size and agglomerates ranged up to about 45 microns. The larger particles above 45 microns comprised dirt, wood, coke, quartz, rust and scale etc. carried over in the furnace stack gas. The silica particles are used to advantage in concrete, mortar and grout as well as in synthetic resin compositions where the large particles tend to detract from the desired characteristics imparted by the silica fume particles that are condensed in the furnace off-gas.

The large particles suspended in the gas stream adjacent to outer wall 44 of the primary separator 36 are separated from the desirable small particles by dividing the stream into two separate streams. Any convenient means may be employed for bleeding off the volume of the gas stream that contains the large particles from adjacent outer wall 44. For example, a damper 46 (FIGS. 4 and 7) may be positioned in conduit 36 adjacent the outer wall to form an outlet port 48 for separating that portion of the gas stream that has a high concentration of large particles. The line of damper 46 (FIG. 7) in the downstream direction beyond outlet port 48 is continued as the exterior wall 47 of the primary separator 36. Outlet port 48 in this typical example was three inches high (A) and two inches wide (FIG. 4).

The separated portion of the air stream having the large particles suspended therein from outlet port 48 may be fed into a conventional cyclone (not shown) for removing the large particles from the separated gas stream. However, a small amount of small particles tend to become entrained with the large particles and for most efficient separation the large particles are stripped of small particles by means of air or gas sifting in accordance with the present invention.

Separation of the small particles from the large particles for best results is carried out in an enclosed secondary particle separator 50 (FIG. 2). The secondary separator may for example have a top cylindrical wall section 52 which in this example was sixteen inches in diameter and twelve inches long. The bottom conical section 54 was twenty two inches long and tapered down to a diameter at the bottom flange 55 of eight inches. A rotating gas lock valve 57 controls withdrawal of large particles from the secondary separator.

In order to separate the portion of the gas stream with high concentration of large particles from the primary separator and feed it into the secondary separator 50, the outer end portion of conduit 36 at the end of the 360° path is welded into the top portion of the wall of cylindrical section 52 to form the outlet port 48 and the inlet into the cylindrical section 52 of the secondary separator (FIG. 2). The new exterior wall 47 of the primary separator conduit 36 is welded to the exterior wall of vessel 50 at outlet port 48. The flow of separated gas with high concentration of large particles into separator 50 is preferably controlled as by means of the damper 46 (FIG. 7) mounted on a rotatable support rod 58 supported in any convenient manner by the wall of vessel 50. The rotatable support rod 58 projects up through the top wall of conduit 36 through a suitable gas seal (not shown). The damper 46 is rotated between a full closed position to fully open in order to control the flow of gas through the two inch wide and three inch high outlet port 48 into separator 50.

The separated portion of the main gas stream from conduit 36 having the large particles suspended therein is fed into the enclosed vessel 50 tangentially adjacent to the wall of cylindrical section 52 and directed to flow downwardly adjacent the wall of the vessel. As best illustrated in FIG. 6, as the gas stream spirals down adjacent the wall, the swirling action tends to cause the small particles to move toward the central open body portion of the vessel while the large particles are concentrated in a relatively thin layer adjacent the wall. In their travel, the large particles pass around the sides of a baffle 64 positioned in known manner in the lower portion of conical section 54.

In order to strip the large particles of the remaining small particles entrained therein, a stream of secondary gas (air) is injected into the lower portion of vessel 50 by one or more inlet ports 66 positioned below baffle 64. The gas injected under pressure through inlet ports 66 flows upwardly in counter current direction to the downward flow of the large particles through the space between baffle 64 and the wall of the vessel 50 to sift the large particles and strip out the small particles that may have been entrained therein. The stream of gas supplied to secondary air inlet ports 66 is controlled in known manner so as to avoid disrupting the downward movement of the large particles and at the same time strip and carry the small particles up through the central open body portion of vessel 50 (FIG. 6) and out through the outlet port 68 in top enclosure 69 of vessel 50. Port 68 is connected to enclosed conduit 70 which as best illustrated in FIGS. 2 and 6 conducts the secondary air from the secondary separation vessel with small particles suspended therein back into the main gas stream as at 72 (FIG. 2) to join the small particles suspended in the main gas stream in conduit 36. In this typical example the secondary air injected into vessel 50 at inlet ports 66 constituted about 10% of the main body of air stream flow entering into the primary separator 36 at the inlet port 40.

The main body of the transport gas stream along with the secondary and small particles suspended therein is fed through section 74 back into pipe 28. Thereafter the small particles are recovered in conventional manner from the gas stream in one or more conventional cyclones 16.

Figure 9:
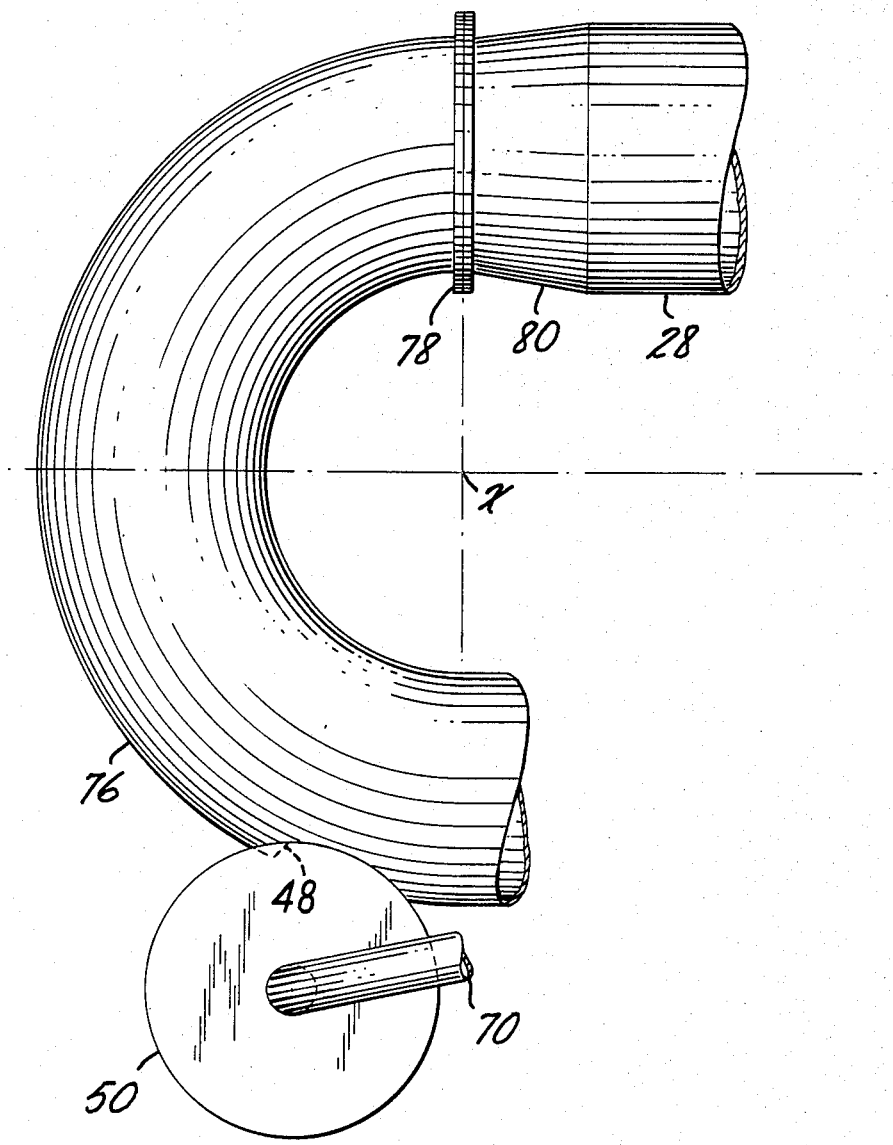
FIG. 9 illustrates an alternate embodiment of the apparatus and system of the present invention.

In a modified embodiment of the system and apparatus shown in FIG. 9, the primary separator is a cylindrical pipe 76 which is connected to pipe 28 by flange connector 78 and by conversion section 80 that in the preferred structure reduces the interior area of pipe 28 as in the case of the primary separator 36. In this modified embodiment the primary separator has a circular path based on a single selected radius from the center 'X' and the center line of the pipe 76 is positioned in a single horizontal plane. In this modified embodiment, the path of the primary separator travels through an arc of 180° before that portion of gas adjacent the outer wall in which the large particles are concentrated is divided and separated from the main stream and fed into a secondary particle separation vessel 50. The secondary particle separation system and apparatus is the same as previously described for the apparatus of FIG. 6 and the secondary air with small particles sifted out from the large particles in vessel 50 are returned to the main stream through enclosed conduit 70.

This modified embodiment 76 of FIG. 9 of the primary separator 36 may be inserted into the primary separator 36 between outlet port 48 and inlet port 72 where secondary air enters primary separator 36 in order to remove a second fraction of medium size particles. The modified primary separator 76 may be used in a series sequence with separator 36 and connected to outlet port 48 by a straight section of pipe 28 or it may be inserted into pipe 28 in front (upstream) of separator 36. Depending on the characteristics of the solid fines in the furnace stack gas, separator 76 may be used in place of the primary separator 36. The arc of 180° may be increased somewhat or reduced to 90° or below to obtain the desired separation of large and small particles where the sizes of the particles may be wide apart. However, for best results the primary 36 and secondary 50 separators of the preferred embodiment of the apparatus and system of the present invention are used to great advantage. Operation of the modified embodiment of primary separator illustrated in FIG. 9 is carried out in the same manner described for separator 36 in accordance with the concept of the present invention as will be obvious to those of skill in the art.

It will be understood that the conventional particle collection system illustrated in the drawings may be used in connection with any industrial process or furnace that generates an off-gas containing particles and in particular the illustrated particle collection system is most effectively used for collecting particles from the stack gas generated in metallurgical furnaces, as for example, those used to produce ferrosilicon, silicon metal, ferromanganese, ferrochromium and silicon alloys such as silicon manganese.

It will be understood that it is intended to cover all modifications of the preferred forms of invention herein chosen for the purpose of illustration which do not constitute a departure from the spirit and scope of the invention.

What is claimed is:

1. Apparatus for separating small silica particles of less than 45 micron size from larger different types of foreign particles in the stack off-gas from a metallurgical furnace which comprises:

(a) a primary particle separator having first enclosed conduit means arranged in a substantially horizontal circular path which has an outer circular portion and an inner circular portion, (b) a secondary particle separator having an enclosed hollow circular vessel with an outlet port at the top and at the bottom thereof and an inlet port in the top portion of said hollow circular vessel, (c) said first enclosed conduit means having an inlet port and an outlet port, (d) means for feeding said stack off-gas containing said large and small particles into said inlet port of said enclosed conduit means to flow in a stream in a first direction in said substantially horizontal circular path downstream toward said outlet port of said enclosed conduit means whereby the larger particles are concentrated in said stream of gas adjacent the interior wall of the outer circular portion of the circular path of said enclosed conduit means in said circular path, (e) the interior area adjacent the outer circular portion of the circular path of said enclosed conduit means being decreased in the circular path in the downstream direction from said inlet port toward said outlet port and the interior area toward the inner circular portion of said enclosed conduit means being correspondingly increased in the circular path in downstream direction toward said outlet port to further concentrate the larger foreign particles in the smaller decreased interior area in the outer portion of the circular path and to suspend the small silica particles in the increased interior area in the remaining portion of the circular path of the enclosed conduit means, (f) means positioned and arranged downstream from the inlet port of said enclosed conduit means for separating stack gas from the outer circular portion of the circular path of said enclosed conduit means in which the larger particles are concentrated and for feeding the separated gas stream into the inlet port of the enclosed hollow circular vessel of said secondary particle separator and tangentially adjacent the inner circular wall of said vessel to flow downwardly in a second circular direction opposite to the first circular direction of flow in said first enclosed conduit means whereby the larger particles are concentrated adjacent the inner wall of said vessel, (g) means for constricting the interior central area of said vessel below the inlet port thereof to further concentrate the downward flow of the larger particles in an annular layer adjacent the inner wall of said vessel, (h) means for feeding a second stream of gas upwardly toward said outlet port of said vessel and through said larger particles in said constricted area of said vessel to air sift the larger particles and strip small silica particles from entrainment with the larger foreign particles and convey the small silica particles upwardly and out through the outlet port at the top of said vessel, (i) means connecting the outlet port at the top of said vessel with the first enclosed conduit means to feed the stream of gas with small silica particles therein from the outlet port of said vessel into the stream of gas containing small silica particles in said enclosed conduit at a location downstream from said means for separating stack gas from the outer portion of the circular path of said enclosed conduit means and upstream from the outlet port of said enclosed conduit means, (j) means connected to the outlet port of said first enclosed conduit means for recovering the small particles of silica from the stream of gas leaving the outlet port of said first enclosed conduit means, and (k) closure means for discharging the larger particles from the outlet port at the bottom of said vessel.

2. The apparatus of claim 1 in combination with an electric furnace for producing ferrosilicon metal and for supplying stack off-gas to said primary particle separator.

3. The apparatus of claim 1 in combination with an electric furnace for producing silicon metal and for supplying stack off-gas to said primary particle separator.

4. Apparatus for separating small particles of less than 45 micron size from larger different types of foreign particles suspended in a stream of gas which comprises:

(a) enclosed conduit means arranged in a substantially horizontal circular path which has an outer circular portion and an inner circular portion and which extends about 360 degrees, (b) said enclosed conduit means having an inlet port and an outlet port, (c) means for feeding said gas stream containing small particles of less than 45 micron size and the larger different types of foreign particles into said inlet port of said enclosed conduit means to flow in a stream in a first circular direction in said substantially horizontal circular path downstream toward said outlet port of said enclosed conduit means whereby the larger particles are concentrated in said stream of gas adjacent the interior wall of the outer circular portion of the circular path of said enclosed conduit means in the circular path, (d) means for reducing the interior area of the outer circular portion of the circular path of said enclosed conduit means along the circular path in the downstream direction toward said outlet port without substantially reducing the total interior area of said enclosed conduit means whereby the larger particles are further concentrated in a smaller interior area in the outer portion of the circular path of said enclosed conduit means, (e) means positioned downstream from said inlet port and upstream from said outlet port of said enclosed conduit means for separating and removing from said enclosed conduit means that portion of the gas stream in the outer circular portion of the circular path of said enclosed conduit means in which the larger particles are concentrated, and (f) means connected to the outlet port of said enclosed conduit means for separating the smaller particles from the remaining portion of the gas stream that flows out from the outlet of said enclosed conduit means.

5. The apparatus of claim 4 including means for maintaining the interior area of said enclosed conduit means constant throughout said circular path so as to compensate for the reduction in the interior area of the outer circular portion of said enclosed conduit means.

6. The apparatus of claim 4 in which the circular path of said enclosed conduit means is arranged in a spiral.

7. The apparatus of claim 4 in which the circular path of said enclosed conduit means is arranged in a helix.

8. The apparatus of claim 4 which includes:

(a) a secondary particle separator having an enclosed circular hollow vessel with an outlet port at the top and at the bottom thereof, (b) inlet port means in the top portion of said vessel positioned and arranged so as to receive that portion of the stream of gas that contains larger particles removed from said enclosed conduit means and for feeding said stream of gas tangentially adjacent the interior circular wall of said vessel to flow in a second circular direction opposite to the first circular direction of flow in said enclosed conduit means whereby the larger particles are concentrated adjacent the inner circular wall of said vessel and move downwardly in a spiral circular flow, (c) means for feeding a second stream of gas upwardly toward the outlet port of said vessel and through said larger particles to strip out smaller particles from said larger different types of particles and to convey said smaller particles upwardly through the outlet port at the top of said vessel, (d) means connecting the outlet port at the top of said vessel with the enclosed conduit means to feed said second stream of gas with small particles therein back into the remaining stream of gas in said enclosed conduit means upstream from the outlet port of said enclosed conduit means and downstream from said means for separating and removing that portion of the gas stream in the outer circular portion of the circular path of said enclosed conduit means, and (e) closure means for discharging the larger particles from the outlet port at the bottom of said vessel.

9. The apparatus of claim 8 in which the enclosed circular vessel has a top cylindrical portion and a lower conical portion, baffle means positioned in the lower portion of said conical portion to provide a space between said baffle means and a wall of the vessel for downward flow of said larger particles, and in which the means for feeding said second stream of gas is located below said baffle means to supply a flow of gas upwardly through the large particles in the space between said baffle means and the wall of the vessel to separate small particles from the larger particles.

10. The apparatus of claim 4 in which the means for separating and removing that portion of the gas stream in the outer circular portion of the circular path of said enclosed conduit means is positioned in the circular path of said enclosed conduit means about 300 degrees away from the inlet port of said enclosed conduit means.

11. The apparatus of claim 4 in which the enclosed conduit means is arranged in a substantially horizontal circle path in which a first circle center is arranged so as to delineate the inner circular portion of the circular path of said enclosed means through the first 180 degrees away from said inlet port and in which a second different circle center is arranged so as to delineate the inner circular portion of the circular path of said enclosed conduit means through the second 180 degrees away from said inlet port which second circle center is spaced away from said first circle center and in which the second circle center is arranged so as to delineate the outer circular portion of the circular path of said enclosed conduit means through the first 180 degrees away from said inlet port and in which the first circle center is arranged so as to delineate the outer circular portion of the circular path of said enclosed conduit means through the second 180 degrees from said inlet port.

12. A process for separating small silica particles of less than 45 micron size from larger different types of foreign particles suspended in a gas stream which comprises the steps of:

(a) moving said gas stream under the constraint in a first direction in a substantially horizontal circular path having an outer circular portion and an innner circular portion through about 360 degrees at a velocity sufficient to cause the larger different types of foreign particles to concentrate in the outer circular portion of the gas stream as it moves through said substantially horizontal circular path, (b) reducing the volume of the gas stream in the outer circular portion of said substantially horizontal circular path without substantially reducing the total volume occupied by said gas stream to further concentrate said larger particles in a smaller volume of gas, (c) separating the outer circular portion of said gas stream in which the larger particles are concentrated from the gas stream to form a first separate stream of gas containing larger particles and a second stream of gas containing smaller particles that continues to move in said first direction in said circular path after the gas stream has moved through about 360 degrees in said substantially horizontal circular path, and (d) recovering the small silica particles from the second separate stream of gas.

13. The process of claim 12 which includes the steps of:

(a) moving the separated outer portion of said first gas stream containing the larger particles therein in a second direction in a second circular path opposite to said first circular direction in said first circular path to concentrate the larger particles in an annular ring in said second circular path, (b) passing a third stream of gas through said annular ring of larger particles to separate the small silica particles from said larger different types of foreign particles, and (c) recovering the small silica particles from said third stream of gas.

14. The process of claim 13 which includes the steps of combining the third stream of gas with small silica particles therein with the second gas stream containing small silica particles therein and recovering the silica particles from said combined second and third gas streams.

* * * * *

UNITED STATES PATENT AND TRADEMARK OFFICE

CERTIFICATE OF CORRECTION

PATENT NO. : 4,526,678

DATED : July 2, 1985

INVENTOR(S) : Jan Myhren and Svein E. Gitlestad

It is certified that error appears in the above-identified patent and that said Letters Patent is hereby corrected as shown below:

Claim 11, line 18 (column 10, line 46), after "degrees" insert --away--.

Claim 12, line 23 (column 11, line 2), before "stream" insert --separate--.

Signed and Sealed this

*Eighth* Day of *October 1985*

[SEAL]

*Attest:*

*Attesting Officer*

DONALD J. QUIGG

*Commissioner of Patents and Trademarks—Designate*